US007284481B2

(12) United States Patent
Kasuya

(10) Patent No.: US 7,284,481 B2
(45) Date of Patent: Oct. 23, 2007

(54) DEVICE AND METHOD FOR TENSIONING A SCREEN ON A SCREEN PRINTING FRAME

(76) Inventor: Furetsu Kasuya, 8-14, Tsudamachi 1-chome, Kodaira-shi, Tokyo 187-0025 (JP)

( * ) Notice: Subject to any disclaimer, the term of this patent is extended or adjusted under 35 U.S.C. 154(b) by 529 days.

(21) Appl. No.: 10/619,461

(22) Filed: Jul. 16, 2003

(65) Prior Publication Data

US 2005/0034614 A1 Feb. 17, 2005

Related U.S. Application Data

(63) Continuation of application No. PCT/JP02/00241, filed on Jan. 16, 2002.

(30) Foreign Application Priority Data

Jan. 16, 2001 (JP) ..... 2001-008049

(51) Int. Cl.
*B05C 17/06* (2006.01)

(52) U.S. Cl. ..... 101/127.1; 38/102.8; 160/374.1

(58) Field of Classification Search ..... 101/114, 101/115, 127, 127.1, 128.1, 128.4, 129; 38/102.1, 102.3, 102.4, 102.5, 102.8, 102.91; 160/372, 374, 374.1, 380, 381
See application file for complete search history.

(56) References Cited

U.S. PATENT DOCUMENTS

| | | | | |
|---|---|---|---|---|
| 3,482,343 A | | 12/1969 | Hamu | |
| 3,485,165 A | * | 12/1969 | Hughes | 101/127.1 |
| 4,893,556 A | | 1/1990 | Takahashi et al. | |
| 5,076,162 A | * | 12/1991 | Goin | 101/127.1 |
| 5,113,611 A | * | 5/1992 | Rosson | 38/102.7 |
| 5,265,534 A | * | 11/1993 | Hamu | 101/127.1 |
| 5,271,171 A | * | 12/1993 | Smith | 38/102.5 |
| 5,802,971 A | * | 9/1998 | Hamu et al. | 101/127.1 |
| 6,427,588 B1 | * | 8/2002 | Kline | 101/127.1 |

FOREIGN PATENT DOCUMENTS

| | | |
|---|---|---|
| EP | 0 962 580 | 12/1999 |
| JP | 44-9074 | 4/1969 |
| JP | 46-22945 | 8/1971 |
| JP | 47-7504 | 3/1972 |
| JP | 52-24709 | 2/1977 |
| JP | 53-28778 | 3/1978 |
| JP | 136533 | 3/1979 |
| JP | 56-091059 | 7/1981 |
| JP | 57-183170 | 11/1982 |
| JP | 58-102768 | 6/1983 |
| JP | 59-160272 | 9/1984 |
| JP | 62-52554 | 3/1987 |
| JP | 63-207646 | 8/1988 |
| JP | 1-131008 | 9/1989 |
| JP | 1-141027 | 9/1989 |
| JP | 01-280558 | 11/1989 |

(Continued)

*Primary Examiner*—Ren Yan
(74) *Attorney, Agent, or Firm*—Wenderoth, Lind & Ponack, L.L.P.

(57) ABSTRACT

The present invention relates to a screen for screen printing. More particularly, structure of the screen can have different types of mesh or sheets joined together. The present invention also relates to a method of detachably spreading a screen to a screen frame.

16 Claims, 13 Drawing Sheets

FOREIGN PATENT DOCUMENTS

| | | |
|---|---|---|
| JP | 02-026831 | 1/1990 |
| JP | 02-065579 | 3/1990 |
| JP | 02-126831 | 5/1990 |
| JP | 2-94125 | 7/1990 |
| JP | 03-103851 | 4/1991 |
| JP | 04-120072 | 4/1992 |
| JP | 05-012165 | 1/1993 |
| JP | 06-055738 | 3/1994 |
| JP | 06-219071 | 8/1994 |
| JP | 07-081035 | 3/1995 |
| JP | 08-150698 | 6/1996 |
| JP | 9-123631 | 5/1997 |
| JP | 9-150497 | 6/1997 |
| JP | 09-256270 | 9/1997 |
| JP | 09-300840 | 11/1997 |
| JP | 10-119447 | 5/1998 |
| JP | 10-315648 | 12/1998 |
| JP | 11-37 | 3/1999 |
| JP | 11-170719 | 6/1999 |
| JP | 2000-015777 | 1/2000 |
| JP | 2000-255175 | 9/2000 |
| JP | 2001-341278 | 12/2001 |
| WO | 92/03231 | 3/1992 |

* cited by examiner

DEVICE AND METHOD FOR TENSIONING A SCREEN ON A SCREEN PRINTING FRAME

This application is a continuation of International Application No. PCT/JP02/00241, with an international filing date of Jan. 16, 2002.

TECHNICAL FIELD

The present invention relates to a screen for screen printing. More particularly, it relates to a novel screen structure having different types of mesh or sheets joined together. Moreover, the present invention relates to a method of detachably spreading a screen to a screen frame, a screen frame used in the method, and a method of fabricating a planar mirror.

BACKGROUND ART

A conventional screen is proposed having a less expandable or mainly metal mesh provided as an image forming portion at a center thereof, and another mesh of a larger size provided about the image forming portion which is greater in terms of elasticity than the image forming portion (Japanese Utility Model Application Publication (JP-Y) No. 51-9297). More specifically, two types of mesh which are different in terms of expandability are joined together to construct the screen. In similar respects, another screen is known having a stainless steel mesh provided as an image forming portion and surrounded by a polyester mesh. Also, a further screen structure is known having an image forming portion located not at a center but biased in an upper, lower, left, or right direction (Japanese Patent Application Laid-open (JP-A) No. 2-00494).

As having at least two meshes overlapped, a combination mask is proposed where an edge of a metal sheet having imaging perforations of a printing surface is implemented by these two overlapped meshes (JP-A No. 9-150497).

Another is proposed having one mesh provided with a reinforcement between a frame and an image forming portion. The reinforcement is a sheet material or is made by curing an adhesive (JP-A No. 11-170719).

Some screens of a mesh and sheet combined type are known having a stainless steel mesh provided as an image forming portion and surrounded by a polyester film.

SUMMARY OF THE INVENTION

However, a joint between two different material screens, such as a metal sheet and a synthetic resin mesh, or between two different types, such as a mesh and a sheet, may be declined in terms of bonding strength, hence resulting in detachment when a spreading force is high. Also, the joint may hardly last long in use.

When two screens are joined or overlapped, their joint generates a step. This step on the screens interrupts movement of a squeegee during printing, hence causing the squeegee to be injured, the joint to be separated, or the screens themselves may be fractured.

As a screen for screen printing is spread while attached, a screen frame has to be rigid enough to withstand a force of tension and its material may be wood or metal. Accordingly, the screen frame will be heavy and bulky.

Also, a screen is commonly attached by an adhesive agent to a screen frame and not allowed to detach readily for ease of storage or transportation.

A screen frame is sometimes saved for re-use in the future. As a screen frame remains loaded with a screen, its storage will require a considerable size of space such as a warehouse and thus be unfavorable in terms of cost-reduction.

Also, when a screen is stored as remaining attached to a screen frame, it may be stretched, thus resulting in distortion of a print image.

In general, a facility for fabricating a screen is distanced from a plant for developing print images or producing prints. It is therefore laborious, uneconomical, and inconvenient to carry or transport a bulky screen frame with a screen from one place to another.

It is also troublesome for re-use to have a screen frame separated from a screen and cleaned down.

Every conventional screen frame arranged variable in length of its frame sides is equipped with a bulky screen size adjusting structure and will thus be handed with much difficulty and hardly be practical.

Also, no screen frame has been proposed in which the screen frame arranged variable in length of its frame sides is improved in combination with screen hooking tools joined with a screen for spreading the screen, controlling tension on the screen, or allowing the screen hooking tools to be attached and detached with ease.

It is not an easy task for increasing quality of printing to eliminate or correct any dimensional error on an object to be printed, or any spreading fault on a screen which may lead to a lift-off printing and create unwanted distortion or skew on a print.

Moreover, it is a good idea for improving quality of printing to conduct a proper correcting action to eliminate any unwanted distortion or skew on a print when a screen has been fixed to a screen frame and operated for trial printing. However, this is not easy.

A screen printing screen frame which is variable in length of its frame sides, and to which a screen is attached with or without use of screen hooking tools fixed to the screen to spread the screen, is provided as characterized by: the screen printing screen frame having each screen frame side thereof, or each frame side intermediate portion, fitted loosely to an end portion of each corner of the screen frame; screen hooking tools fixed to the screen; fitting portions or joints on an upper surface of each frame side of the screen frame for detachably fitting and hooking the screen hooking tools; and screen frame side length extensible structure which consists mainly of male thread receivers provided with female threads provided to extend from each end of each frame corner via the frame side to a corresponding end of another frame corner, or female threads provided in the frame side intermediate portions and male threads provided for mating with the male thread receivers or the female threads of the frame corners.

A screen printing screen frame having frame sides made of a metal or a synthetic resin material and arranged of an orthogonal shape, a hollow orthogonal shape, a C shape, or an L shape in cross section for spreading a screen printing screen is provided as characterized by: frame sides of a hollow tube closed, or frame sides of a hollow tube provided with openings at one end and having an orthogonal shape, a C shape or an L shape in cross section and welded or fixed to one another; a number of thread apertures provided in side surfaces of the hollow or orthogonal frame sides or in inner or outer side surfaces, or the inner, outer, or both side surfaces of C shape frame sides or in the side and outer sides of L shape frame sides; tension adjusting bars having a predetermined number of thread apertures and a predetermined number of female thread apertures provided at corresponding portions relative to the thread apertures; and tension adjusting screws threaded into the female thread apertures and inserted into or built-in hollows of the frame sides, into the orthogonal frame sides, into the C shape of the C shape frame sides, or into the L shape frame sides, wherein tension on the screen is controlled by the frame sides deflecting horizontally with the tension adjusting screws moving forward and backward to thus eliminate unwanted distortion or skew of images on a print. Also, a method of bonding, curing, and embossing mesh or sheet screens comprises steps of: butt joining or overlap joining screens together; providing a peelable sheet or an embossed peelable sheet on upper, lower, or both sides of a bonded or cured joint, and securing the joint with an adhesive agent or by thermal fusing, or providing a set of molds for the joint and filling the molds with a molding agent; removing the peelable sheet or the embossed peelable sheet or the molds after the molding agent is cured; and smoothing upper, and lower, or both sides of a bonded or cured joint, whereby a step at the joint between the screens is filled or the mesh is sealed with an adhesive agent, and the screens are covered with a layer of the adhesive agent or embossed at the surface.

Also, a method of spreading a screen printing screen comprises: providing hooking portions in a screen frame, which is variable in each side length, for accepting screen hooking tools; hooking the screen hooking tools of a screen into the hooking portions or otherwise fixing the screen to the screen frame; and adjusting a length of each side of the screen frame with use of screen frame adjusting structure to provide a tension on the screen suited for printing.

Moreover, a screen frame which is variable in length of its sides is provided as characterized by one of: (1) assembling four L-shaped corners and four frame sides, which have insertion apertures provided in both ends thereof for accepting the L-shaped corners, by inserting the four L-shaped corners at their end into the insertion apertures to develop a screen frame construction provided with screen frame side length extensible structure; (2) locating four L-shaped frame sides, each frame side composed of a long side and a short side joined in an L shape and having an insertion aperture provided in one end of the long side thereof for accepting the short side of an adjacent L-shaped frame side, so that the long side of each frame side is opposite to the short side of a neighboring frame side, and inserting the short sides into corresponding long sides to develop a screen frame construction provided with screen frame side length extensible structure; and (3) assembling four L-shaped corner frame sides, defined by separating a screen frame at a center of each side and having insertion apertures provided in both ends thereof for accepting auxiliary frame sides, by inserting the auxiliary frame sides into corresponding insertion apertures of the L-shaped corner frame sides to develop a screen frame construction provided with screen frame side length extensible structure.

According to an aspect of the present invention, a screen can precisely be adjusted for correcting images on a print once printed by inserting tension adjusting bars of metal into openings of hollow frame sides of a screen frame, threading screws into tension adjusting screw apertures provided in inner or outer or both surfaces of frame sides and female thread apertures provided in the tension adjusting bars, and moving the tension adjusting screws horizontally to and from the frame sides to thus deflect the screen.

With the tension adjusting screws moved forward and backward from outside of the frame sides, tension on the screen can be adjusted to eliminate unwanted distortion or skew of image on a print.

The screen frame is constructed where hollow frame sides of aluminum or any other metal arranged of an orthogonal shape in cross section are jointed by welding, with an opening at one end thereof exposed.

The frame sides may be arranged of a C shape or an L shape in cross section with equal success.

Each of the frame sides of the screen frame has screw apertures provided at given intervals in inner, outer, or both surfaces thereof through which the tension adjusting screws are threaded. The tension adjusting bar of a hollow form also has thread apertures provided corresponding to the screw apertures of the frame side and are inserted into an opening of corresponding frame side (four bars in total).

The tension adjusting bars may be made of metal having an orthogonal shape in cross section. As the tension adjusting bars are deflected by action of the screws, they are preferably high in terms of hardness (e.g., as tempered).

The tension adjusting bars are tightened at both ends to corresponding frame sides by retaining screws threaded vertically from above. The retaining screws at both ends can thus act as fulcrums for slightly deflecting a frame side at its center.

Male screws are provided for inserting through screw apertures of the frame sides and the thread apertures of the tension adjusting bars for joining the frame sides to the tension adjusting bars.

As a screen has been attached to the screen frame, tension on the screen can be adjusted after trial printing of images by the following manner.

With the tension adjusting screws moved forward and backward separately, the frame sides can slightly be deflected inward and outward to thus adjust tension on the screen.

Also, turning of the male screws may be driven by an external servo motor.

Alternatively, this turning movement can desirably be controlled by a computer calculating discrepancy of an image between a screen and its print from a location of image positioning markings at every action of printing, and determining a distance for movement of the screen frame.

As the screen frame is loaded with a screen, its frame sides can precisely be deflected inwardly and outwardly by horizontally moving the tension adjusting screws from outside and inside to eliminate unwanted distortion or skew on the screen after trial printing of an image.

The tension adjusting screws may be headless screws with a top slotted, a set screw, or common machine screws with a head.

The tension adjusting screws may be provided at either an inner or outer side or both sides of each frame side as described in disclosed embodiments. When a frame side is provided with screws at both sides, it can be tightened from both sides with two screws urging in opposite directions, thus being in a so-called double locking state. This permits screen frames to remain stationary after adjustment, thus being advantageous for use in precision screen printing.

As the screen frame is simply deflected for minimum adjustment, it can be prevented from physical breakdown.

DETAILED DESCRIPTION OF THE PREFERRED EMBODIMENTS

Embodiment 1

Figure 1A:
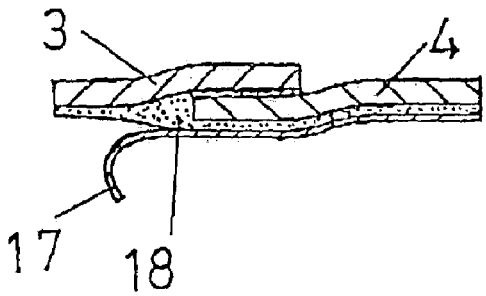
FIGS. 1(*a*)-1(*h*) illustrate cross sections of an enlarged part of a screen explaining steps of joining screens, with FIGS. 1(*a*) and 1(*b*) being partially enlarged cross sectional views of screens showing steps of bonding, FIGS. 1(*c*) and 1(*d*) being partially enlarged cross sectional views of screens showing a step of bonding and completion of bonding, FIGS. 1(*e*) and 1(*f*) being partially enlarged cross sectional views of screens showing a step of bonding and completion of bonding, and FIGS. 1(*g*) and 1(*h*) being partially enlarged cross sectional views of screens showing a step of bonding and completion of bonding.
Figure 1B:
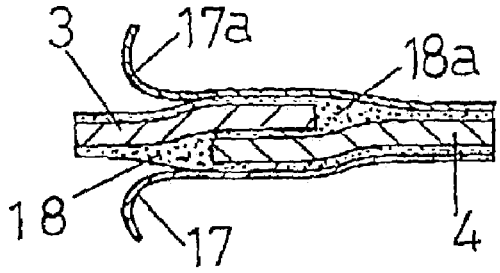
Figure 1C:
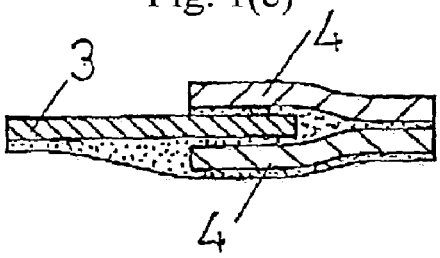
Figure 1D:
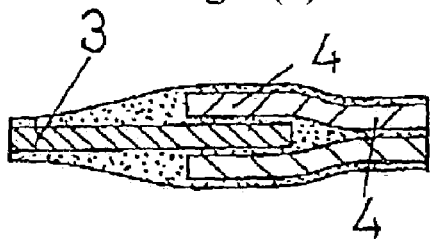
Figure 1E:
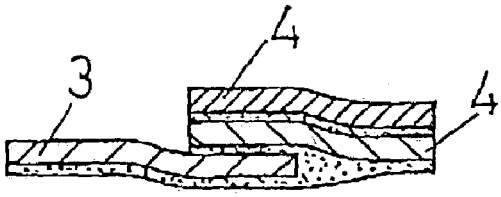
Figure 1F:
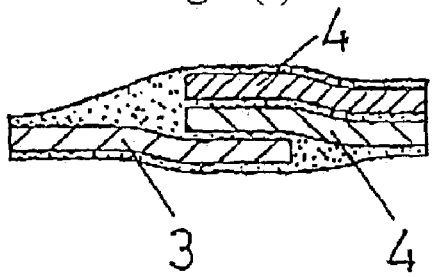
Figure 1G:
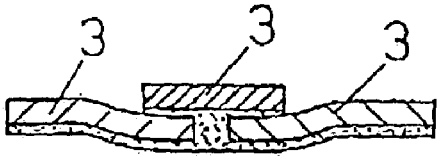
Figure 1H:
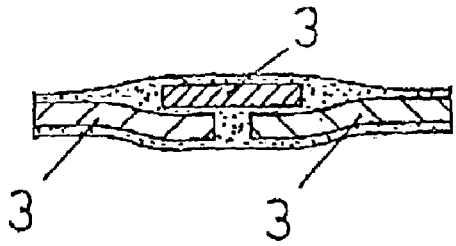

Embodiment 1 will be described referring to FIGS. 1(*a*)-(*h*).

This is an inventive method of joining screen materials (meshes or sheets) together.

The inventive method is favorable where different screens are joined together to have a more intricate screen structure.

For bonding, curing, and embossing of mesh or sheet screens, the method comprises steps of butt joining or overlap joining screens together, providing a peelable sheet or an embossed peelable sheet on upper, lower, or both sides of a bonded or cured joint and securing the joint with an adhesive agent or by thermal fusing or providing a set of molds for the joint and filling the molds with a molding agent, removing the peelable sheet or the embossed peelable sheet or the molds after the molding agent is cured, and smoothing the upper, and lower, or both sides of the bonded or cured joint, whereby a step at the joint between the screens is filled or the mesh is sealed with an adhesive agent and the screens are covered with a layer of the adhesive agent or embossed at the surface.

The joining of screens will be explained in more detail.

This embodiment is mainly featured with bonding, butt joining, and overlap joining of different screens.

For bonding a small screen to a large screen, or joining different screens together in a patch-work arrangement, one is placed over or under another, thus inevitably creating a step along a joint. When a squeegee is used over a screen surface with such a step present, its movement may be not smooth and instead interrupted which results in damage to the screens. It is also common for overlap joining of screens to create a step along a joint. A technique for eliminating the step will now be explained.

A joint between screens created by bonding, thermal fusing, or sealing is protected with a length of embossed peelable tape. As the joint has an embossed surface and its recessed portions serve as tiny ink pools permitting ink to be milled with a squeegee, it can contribute to an improvement in printing.

As a joint with an adhesive agent is strengthened, smoothed, or embossed, it will hardly be fractured. Also, when screens to be joined are of a mesh type, the adhesive agent can be smoothly applied from a lower side.

When the joint is embossed, its recessed portions receive ink and the squeegee is allowed to move forward and backward over and thus mill the ink, hence contributing to an improvement in printing.

When the screens of a mesh type have to be sealed, use of a peelable tape can increase efficiency and quality of sealing.

For screens being provided with a layer of an adhesive agent or being embossed, use of molds with the adhesive agent or a molding agent can cover a wider area at higher uniformity and efficiency.

FIGS. 1(*a*)-(*h*) are described in more detail.

FIG. 1(*a*) illustrates joining of a first screen 3 and a second screen 4. A peelable sheet 17 is attached by an adhesive agent to a lower side of a joint to develop a bonded region 18 before the adhesive agent is dried. Then, the adhesive agent is applied to an upper side to develop another bonded region 18*a* as shown in FIG. 1(*b*). A peelable sheet 17*a* is provided to smooth this bonded region. After the adhesive agent is dried, the peelable sheet 17*a* is removed. Embossed surfaces can be obtained when the peelable sheets are of an embossed type.

FIGS. 1(*c*), 1(*d*), 1(*e*), 1(*f*), 1(*g*), and 1(*h*) illustrate other examples of joining and their descriptions are omitted.

Embodiment 2

Embodiment 2 will now be described referring to FIGS. 2(*a*)-3(*c*).

The following is a technique for attaching a screen to a screen frame.

A method of spreading a screen printing screen comprises steps of: providing hooking portions in a screen frame, which is variable in each side length, for accepting screen hooking tools; hooking screen hooking tools of a screen into the hooking portions or joining the screen to the screen frame; and adjusting a length of each side of the screen frame with use of screen frame adjusting structure to provide tension on the screen suited for printing.

Figure 2A:
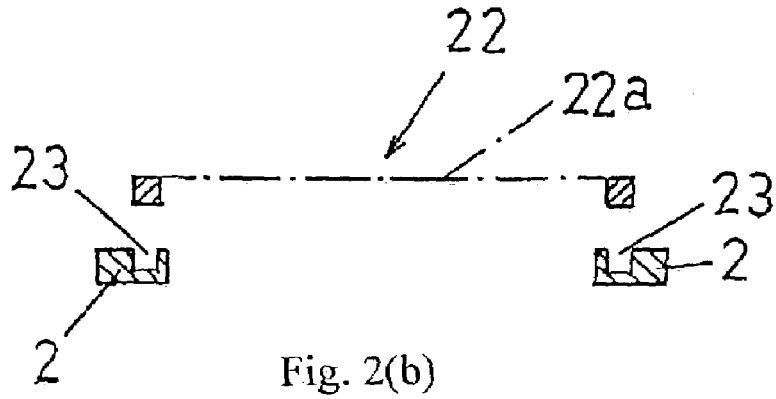
FIGS. 2(*a*)-2(*c*) illustrate steps of spreading a screen, with FIG. 2(*a*) being a view showing a relationship between screen hooking tools joined with the screen and a screen frame, FIG. 2(*b*) being a schematic view showing a step of expanding a screen frame to which the screen hooking tools joined with the screen are attached, and FIG. 2(*c*) being a schematic view showing a step of spreading the screen through expanding the screen frame to which the screen hooking tools joined with the screen are attached.
Figure 2B:
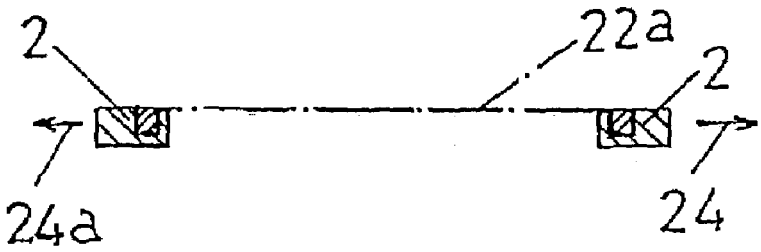
Figure 2C:
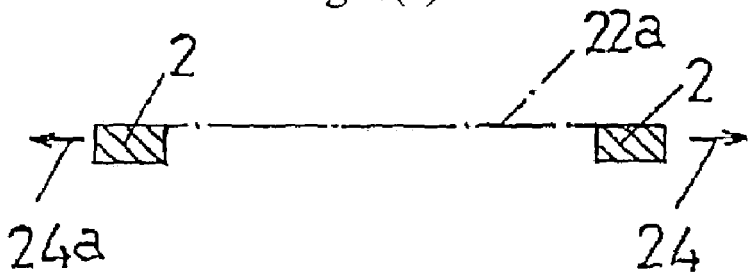

FIGS. 2(*a*)-2(*c*) illustrate a primary conception of a method of attaching a screen to a screen frame according to one embodiment of the present invention.

FIGS. 2(*a*) and 2(*b*) show a screen 22*a* held with its screen hooking tools 22 and spread by expanding two sides of a screen frame 2 in opposite directions 24 and 24*a* (outwardly of the screen frame).

Some examples of structure for expanding the two sides of the screen frame 2 are explained below.

FIG. 2(*c*) illustrates an example for attaching a screen to a screen frame where screen 22*a* secured to screen frame 2 is spread by moving two sides of the screen frame 2 in opposite directions 24 and 24*a*.

Some examples of structure for moving the two sides of the screen frame 2 are explained below.

The description is made in two steps.

(A) spreading of the screen 22*a*, which is attached with its screen hooking tools 22 to hooking portions 23 provided on sides of a screen frame that is variable in its side length.

Figure 3A:
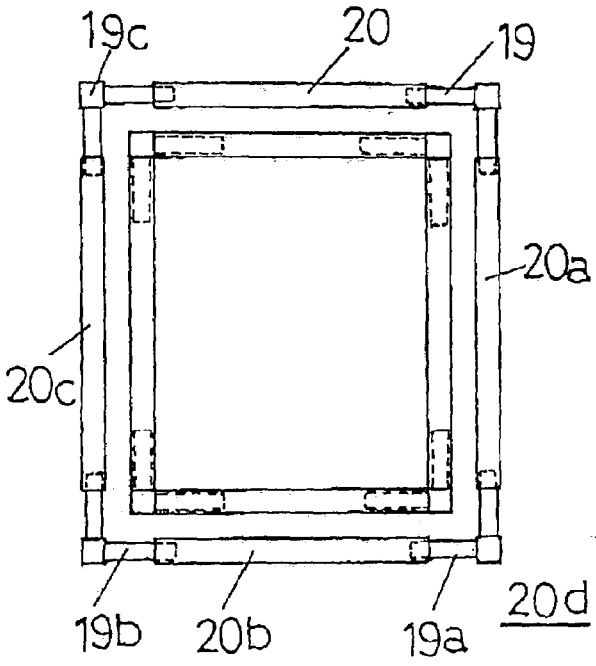
FIGS. 3(*a*)-3(*c*) illustrate examples of a screen frame arranged variable in a frame side length, with FIG. 3(*a*) being a plan view showing one example of a screen frame equipped with auxiliary frame sides before and after expansion, FIG. 3(*b*) being a plan view showing another example of a screen frame equipped with no auxiliary frame sides before and after expansion, and FIG. 3(*c*) being a plan view showing a further example of a screen frame equipped with auxiliary frame sides at a center of each side before and after expansion.
Figure 3B:
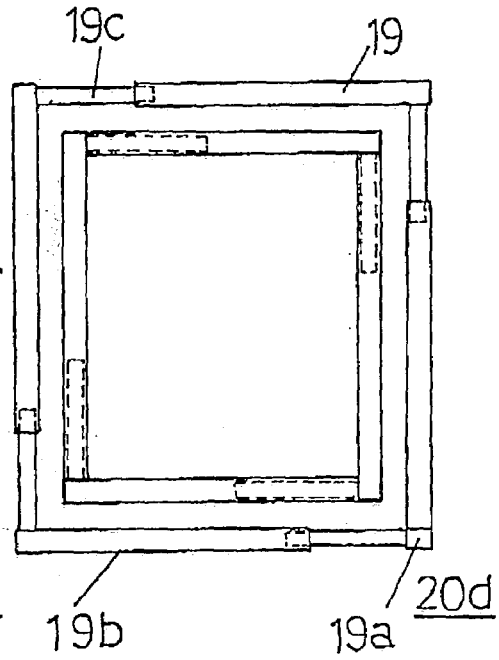
Figure 3C:
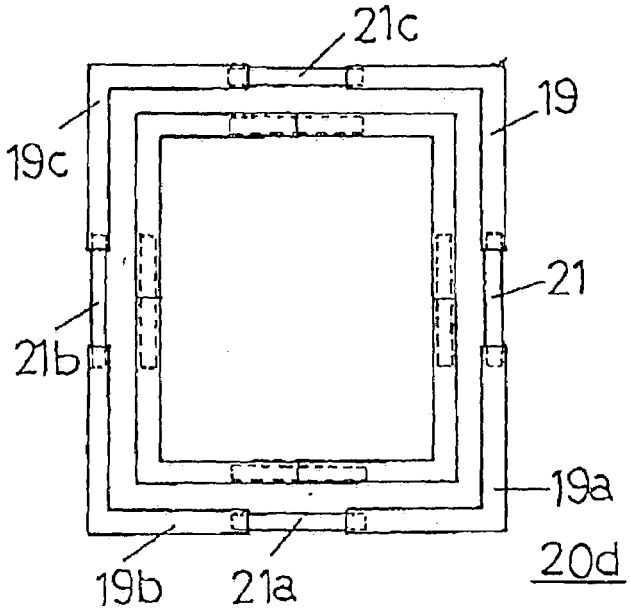

The hooking portions 23 of the screen frame are not shown in FIGS. 3(*a*)-3(*c*).

Each hooking portion 23 is provided on a top, outer, or inner surface of one of two opposite sides of an orthogonal or odd-number sided shape, or of two adjacent sides or all sides of the screen frame. More specifically, at least one of the hooking portions 23 is implemented in the form of a groove, projection, or opening for accepting a corresponding screen hooking tool 22. With its screen hooking tools 22 received by the hooking portions 23, the screen can be spread.

With its hooking portions 23 holding the corresponding screen hooking tools 22, the screen frame is adjusted by expanding or contacting a length of its sides with screen frame adjusting structure to provide tension on the screen suited for printing. After printing, the screen frame is retracted and separated from the screen hooking tools 22 of the screen.

The screen frame adjusting structure may be implemented by a screw mechanism, a gear mechanism, a cylinder mechanism, a cam mechanism, a spring mechanism, a magnetic repulsion or attraction mechanism, a wedge mechanism, a telescopic mechanism, or a sliding mechanism which is driven by an electric, pneumatic, or hydraulic motor.

The screen may be spread with the following structure.

The hooking portions 23 are provided on corresponding horizontal sliders 26. The hooking portions 23 are sized so that the horizontal sliders can travel parallelly and horizontally outwardly of the frame sides.

The hooking portions 23 are implemented in the form of grooves, projections, or openings on a top, outer, or inner surface of the horizontal sliders 26 thus to receive and hold the corresponding screen hooking tools 22 for spreading.

As the hooking portions 23 have received corresponding screen hooking tools 22, the horizontal sliders 26 are driven by a horizontal driving structure selected from a screw mechanism, a gear mechanism, a cylinder mechanism, a cam mechanism, a spring mechanism, a magnetic repulsion or attraction mechanism, a wedge mechanism, a telescopic mechanism, or a sliding mechanism which is powered by an electric, pneumatic, or hydraulic motor.

The spreading of the screen can thus be controlled by determining a distance of movement of the horizontal sliders.

Another example is provided where a screen printing screen 22*a* is spread with a combination of a screen frame 20*d* arranged variable in a length of each side and screen hooking tools 22 joined to the screen 22*a*. The screen hooking tools 22 (joined to the screen 22*a*) are used under no tension.

Tension of the screen can be controlled by expanding sides of the screen frame.

This allows the screen hooking tools 22 to be removed from the screen frame after completion of printing and stored with the screen 22*a* being not spread. Accordingly, the screen 22*a* is prevented from unwanted stress or deformation during storage and its operating life can be increased. As the screen 22*a* is stored and reused throughout a significant duration of time, it is particularly advantageous when the same printing is repeated at equal or different intervals of time.

After completion of printing, the screen hooking tools 22 joined to the screen 22*a* are removed from the screen frame 20*d* and saved for re-use. Also, as the screen hooking tools 22 are joined with the screen 22*a* which is not bulky, their storage requires no extended space and will thus be economical. Their transportation will also be less troublesome.

As the screen hooking tools 22 are removed from the screen frame just after completion of printing and minimized in terms of both weight and size, they can be stored and transported with no difficulty.

More particularly, a screen frame which has sides that are variable in length is prepared by assembling four L-shaped corners and four frame sides, which have insertion apertures provided in both ends thereof for accepting the L-shaped corners. This assembling includes any of: (1) inserting the four L-shaped corners at their ends into the insertion apertures to develop a screen frame construction provided with screen frame side length extensible structure; (2) locating four L-shaped frame sides, each frame side composed of a long side and a short side joined in an L shape and having an insertion aperture provided in one end of the long side thereof for accepting the short side of an adjacent L-shaped frame side, so that the long side of each frame side is opposite to the short side of a neighboring frame side, and inserting the short sides into corresponding long sides to develop a screen frame construction provided with screen frame side length extensible structure; and (3) assembling four L-shaped corner frame sides, defined by separating a screen frame at a center of each side and having insertion apertures provided in both ends thereof for accepting auxiliary frame sides, by inserting the auxiliary frame sides into corresponding insertion apertures of the L-shaped corner frame sides to develop a screen frame construction provided with screen frame side length extensible structure.

FIGS. 3(*a*), 3(*b*), and 3(*c*) illustrate pairs of the screen frames, with an inner and outer of each pair representing before and after expansion of frame sides. Also, as screen corners 19, 19*a*, 19*b* and 19*c* are modified in size, their joining to corresponding frame sides is shown in different forms.

FIG. 3(*c*) illustrates four auxiliary frame sides 21, 21*a*, 21*b*, and 21*c*. At least two of the auxiliary frame sides 21, 21*a*, 21*b*, and 21*c* may be used at each side depending on a size of the screen frame.

It would also be understood that each side of the screen frame is separated into not only two but also three or more portions. Joining between two frame sides, between each corner and a frame side, or between two corners may be implemented by a repulsing and attracting action of a mechanism.

Structure for expanding a frame side length of the screen frame may be implemented by a screw mechanism, a gear mechanism, a cylinder mechanism, a cam mechanism, a spring mechanism, a magnetic repulsion or attraction mechanism, a wedge mechanism, a telescopic mechanism, or a sliding mechanism which is driven by an electric, pneumatic, or hydraulic motor. As a large construction of the screen frame (e.g., 2 m×2 m) is hardly operated by hand, it can be equipped with an appropriate driving mechanism.

Figure 4A:
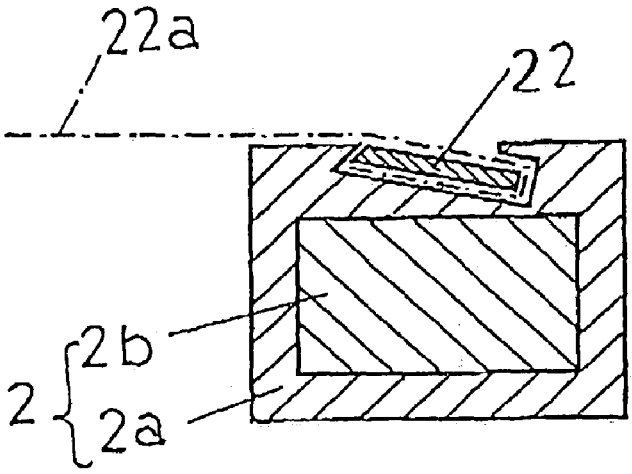
FIGS. 4(*a*)-4(*c*) illustrate cross sections of a frame side of a screen frame arranged variable in a frame side length, with FIG. 4(*a*) being a cross sectional view of one construction of a frame side, FIG. 4(*b*) being a cross sectional view of another construction of a frame side, and FIG. 4(*c*) being a cross sectional view of a further construction of the frame side.
Figure 4B:
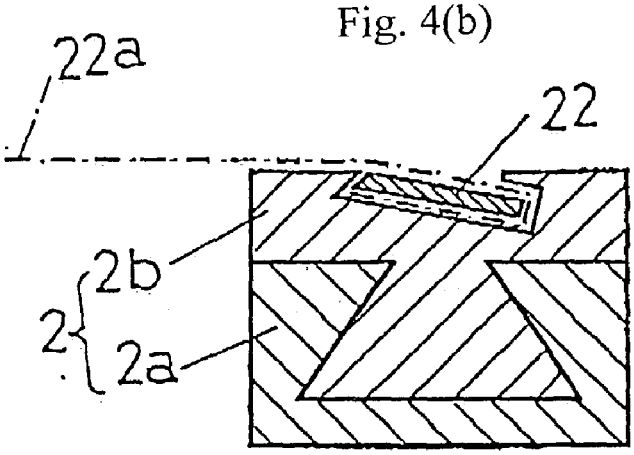
Figure 4C:
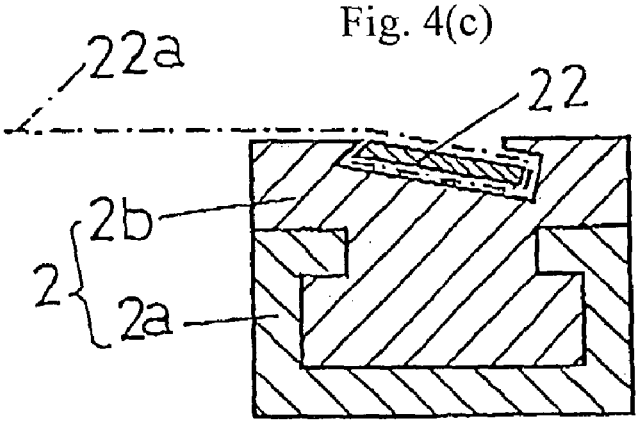

FIGS. 4(*a*), 4(*b*), and 4(*c*) illustrate examples of a screen frame arranged variable in terms of its side length (a cross section of each frame side having one section arranged sliding along another). So long as the frame side has one section arranged for sliding along another for modifying a frame side length, its arrangement may be of no limitations.

Figure 5A:
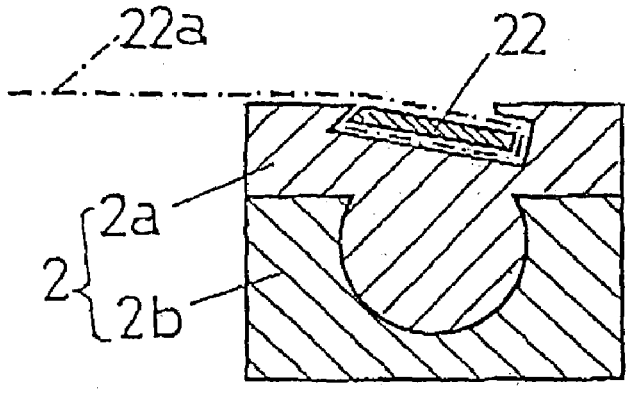
FIGS. 5(*a*)-5(*b*) illustrate cross sections of a frame side arranged variable in length, with FIG. 5(*a*) being a cross sectional view of a further construction of a frame side, and FIG. 5(*b*) being a cross sectional view of a still further construction of the frame side.
Figure 5B:
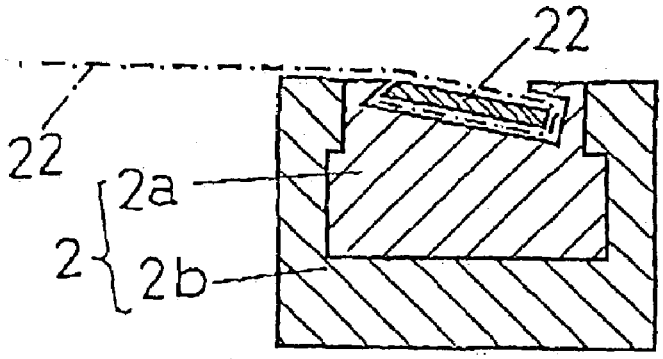

FIGS. 5(*a*) and 5(*b*) illustrate further examples of a screen frame arranged comprising two sections for one section sliding along another for changing a side length (a cross section of each frame side having one section arranged sliding along the other). So long as the frame side has one section arranged for sliding along the other for modifying a frame side length, its arrangement may be of no limitations.

The structure for expanding the side length of the screen frame may be implemented by a cylinder mechanism, a cam mechanism, a spring mechanism, a jack mechanism, an electromagnetic repulsion and attraction mechanism, a telescopic mechanism, or a slider mechanism.

This mechanism is provided inside or outside the screen frame and can be operated for expanding and contracting the frame side length.

The screen hooking tool 22 may be a frame which has a physical strength for attaching the screen at a tension not creating wrinkles, a physical strength for attaching the screen with no tension applied, each corner joined with an elastic material, each corner arranged flexible, each corner joined but not tightened, or each corner made of an elastic material.

The screen hooking tool 22 may be arranged flexible for expanding or contracting in a given range along the frame side.

The hooking portion 23 for receiving the screen hooking tool 22 may have a groove, dovetail, or slot construction provided on a top, outer, or inner surface of each frame side or two adjacent sides of the screen frame. Alternatively, the hooking portion 23 may be a projection(s) provided on the top, upper, or inner surface of each frame side for engaging with a corresponding recess(es) provided in the screen hooking tool 22. The hooking portion 23 may be a recess(es) provided in the top, upper, or inner surface of each frame side for engaging with a corresponding projection(s) provided on the screen hooking tool 22. The hooking portion 23 may be a male or female thread(s) provided on or in the top, upper, or inner surface of each frame side for thread engaging with a corresponding female or male thread(s) of the screen hooking tool 22.

(B) Tensioning of the screen 22*a* which is directly joined to the screen frame 20*d* arranged variable in terms of its frame side length.

The screen 22*a* is joined with no use of the screen hooking tools 22, but rather directly to the screen frame 20*d* which is then adjusted in a side length for spreading the screen 22*a*.

As the screen is directly joined to the screen frame, it can never be detached. Spreading of the screen can be made by controlling a length of the frame sides of the screen frame. The screen frame can be reused when the screen is replaced with a new one after completion of printing.

A technique for expanding and contracting the frame sides of the screen frame is identical to that of the previous embodiments and no further description will be made.

Embodiment 3

Embodiment 3 will be described referring to FIGS. 6(*a*) and 6(*b*).

This relates to a screen frame employing a method of attaching a screen to a screen frame.

Hooking portions 23 for receiving screen hooking tools 22 are not illustrated and will be explained in no more detail.

A screen printing screen frame which is variable in length of its frame sides, and to which a screen is attached with/without use of screen hooking tools fixed to the screen to spread the screen, is characterized by: the screen printing screen frame having each frame side thereof or each screen frame side intermediate portion thereof arranged for fitting loosely to each frame corner of the screen frame; the screen hooking tools fixed to the screen; fitting portions or joints of the screen fitting and hooking the screen hooking tools provided on an upper surface of each frame side for detachable connection, and screen frame side length extensible structure which consists mainly of male thread receivers provided with female threads provided to extend from each end of the frame corner via the frame side to a corresponding end of another frame corner or female threads provided in the frame side intermediate portions; and male threads provided for mating with the male thread receivers or the female threads of the frame corners.

The screen can be attached and detached with a combination of the screen hooking tools 22 and the screen frame arranged variable in length of its frame sides.

This allows a screen joined with the screen hooking tools 22 to be detached from the screen frame after completion of printing and stored with no tension being applied. Accordingly, the screen can be protected from over-stretching or distortion when stored, and thus increased in terms of its operating life and storage period. This is particularly advantageous when the same printing is repeated at equal or different intervals of time.

After completion of printing, the screen hooking tools 22 joined to the screen are removed from the screen frame and saved for re-use. Also, their storage with the screen, which is not bulky, requires no extended space and will thus be economical. Their transportation will also be less troublesome.

As the screen hooking tools 22 are removed from the screen frame just after completion of printing and minimized in both weight and size, they can be stored and transported with no difficulty.

Figure 6A:
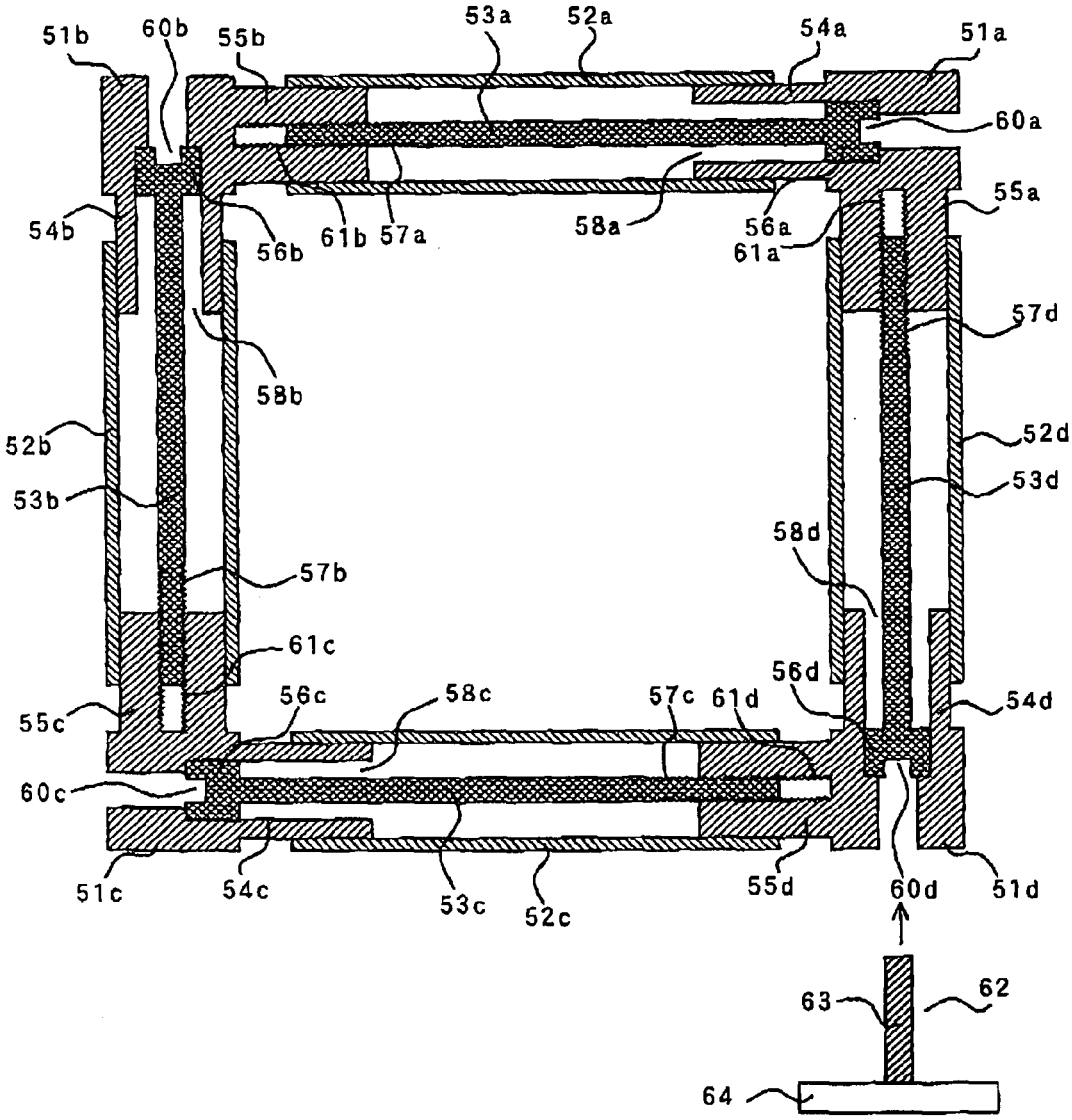
FIGS. 6(*a*)-6(*b*) illustrate a screen frame arranged variable in a length of its frame sides, with FIG. 6(*a*) being a plan view and FIG. 6(*b*) being a cross sectional view taken along line K-K of FIG. 6(*a*)
Figure 6B:
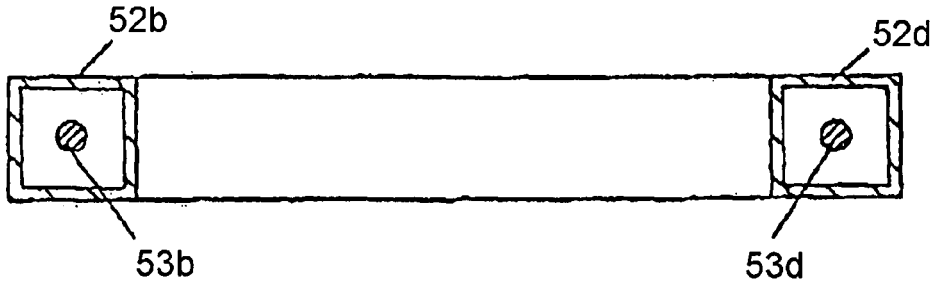

(1) FIGS. 6(*a*) and 6(*b*) illustrate an arrangement of a screen frame arranged variable in side length (excluding screen hooking tools 22 and receptacles for the screen hooking tools 22).

The screen frame of FIG. 6(*a*) comprises: frame corners 51*a*, 51*b*, 51*c* and 51*d* forming four orthogonal corners of a rectangular frame; frame sides 52*a*, 52*b*, 52*c* and 52*d* forming four sides of the rectangular frame; and four long bolts 53*a*, 53*b*, 53*c* and 53*d*.

The frame corners 51*a*, 51*b*, 51*c* and 51*d* all have the same shape. The frame corner 51*a*, for example, has an L shape defined by corner ends 54*a* and 55*a* each having a square shape in cross section and disposed orthogonally.

The corner end 54*a* is provided with an aperture 58*a* extending longitudinally through a center thereof. Corner end 55*a* is provided with a longitudinally extending female thread aperture 61*a*.

The frame sides 52*a*, 52*b*, 52*c* and 52*d* have the same shape, with the frame side 52*a* and the frame side 52*c* at opposite positions of the rectangular frame having the same length, with the frame side 52*b* and the frame side 52*d* at opposite positions of the rectangular frame have the same length, and with these two lengths not necessarily being the same. Each frame side has, for example, a hollow square shape in cross section.

The hollow square shape in cross section of the frame side 52*a* allows the corner end 54*a* of the frame corner 51*a* and a corner end 55*b* of the frame corner 51*b* to fit therein.

The bolts 53*a*, 53*b*, 53*c* and 53*d* have the same shape, with the bolts 53*a* and 53*c* placed opposite each other in the rectangular frame having the same length, with bolts 53*b* and 53*d* placed opposite each other in the rectangular frame having the same length, and with these two lengths not necessarily being the same. The bolt 53*a* has, for example, a socket head 56*a* at its top provided with a hole 60*a* for operation and a male thread 57*a* at its leg portion to be fitted into a female thread aperture 61*b* provided in corner end 55*b* of the frame corner 51*b*.

For the frame corner 51*a*, corner end 54*a* is entered into one hollow end of the frame side 52*a* and corner end 55*a* is entered into one hollow end of the frame side 52*d*.

The bolt 53*a* is put into the aperture 58*a* and its head 56*a* is placed rotatably in the enlarged portion 59*a*.

The male thread 57*a* of the bolt 53*a* is fitted into the female thread aperture 61*b* formed in the corner end 55*b* of the frame corner 51*b*.

All of the elements: four frame corners 51*a*, 51*b*, 51*c* and 51*d*; four frame sides 52*a*, 52*b*, 52*c* and 52*d*; and four long bolts 53*a*, 53*b*, 53*c* and 53*d* are arranged as described above to construct the screen frame.

In the screen frame, for operating bolt 53*d*, for example, a portion 63 of a wrench 62 is inserted into a hole 60*d* on a socket head 56*d* of the bolt 53*d*, which is put into the frame corner 51*d*, and a handle 64 of the wrench 62 is turned. Thus, a space between the frame corner 51*a*, where the female thread aperture 61*a* is formed to receive a male thread 57*d* of the bolt 53*d*, and the frame corner 51*d*, where the bolt 53*d* enters, varies.

The shape of the screen frame, thus, can be varied and adjusted by only operating four bolts.

Turning of the male threads may be performed by an external servo motor. Alternatively, this turning movement can desirably be controlled by a computer calculating discrepancy of image between the screen and its print from a location of image positioning markings for every action of printing, and determining a distance for movement of the screen frame.

As the screen frame is varied in length of its frame sides by action of threads, its spreading of the screen can be controlled precisely and favorably.

Figure 7A:
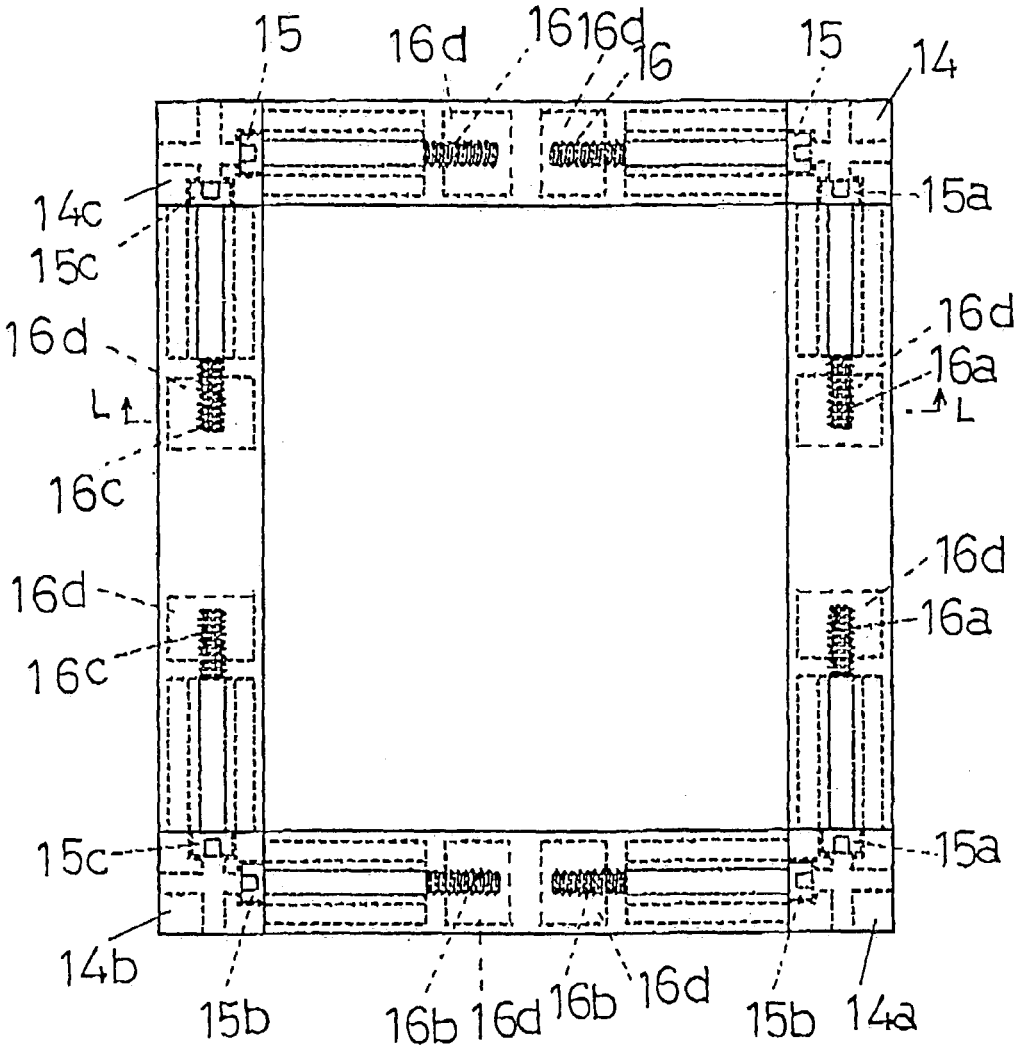
FIGS. 7(*a*)-7(*b*) illustrate a screen frame arranged variable in a length of its frame sides and provided with male thread receivers, with FIG. 7(*a*) being a plan view showing the male thread receivers and FIG. 7(*b*) being a cross sectional view taken along line L-L of FIG. 7(*a*)
Figure 7B:
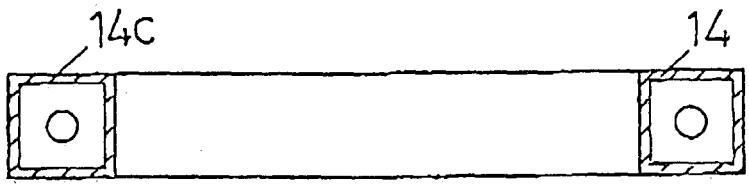

(2) FIGS. 7(*a*) and 7(*b*) are explained.

This construction is similar to that shown in FIGS. 6(*a*) and 6(*b*) and has male thread receivers 16*d* provided in an intermediate portion of each frame side. The male thread receivers 16*d* include female threads 16, 16*a*, 16*b*, and 16*c* located in an intermediate region of a hollow portion of a frame side of the screen frame. When the screen frame is great in size (e.g., 2 m×2 m), the male threads 15, 15*a*, 15*b*, and 15*c* have to be lengthened in construction (1). This construction employs the male thread receivers 16*d*, thus permitting the male threads not to be lengthened.

A function of this construction is identical to the previous construction (1) and will be explained in no more detail.

Embodiment 4

Embodiment 4 will be described referring to FIGS. 8, 9, 10(*a*)-10(*c*), 11, and 12.

This provides a screen frame arranged for finely controlling tension on a screen to correct any unwanted distortion or skew on prints when the screen has been attached.

Such a hollow screen frame 35 is provided for finely controlling tension on a screen printing screen after having been attached, spread, and operated for trial printing.

The hollow screen frame 35 comprises four frame sides 36, 36*a*, 36*b*, and 36*c* made of a hollow (30×40 mm in cross section) metal tube (of aluminum having a thickness of 2 mm), having openings 40, 40*a*, 40*b*, and 40*c* respectively provided in each end thereof, and joined by welding to one another to build a 950×950 mm construction.

Figure 8:
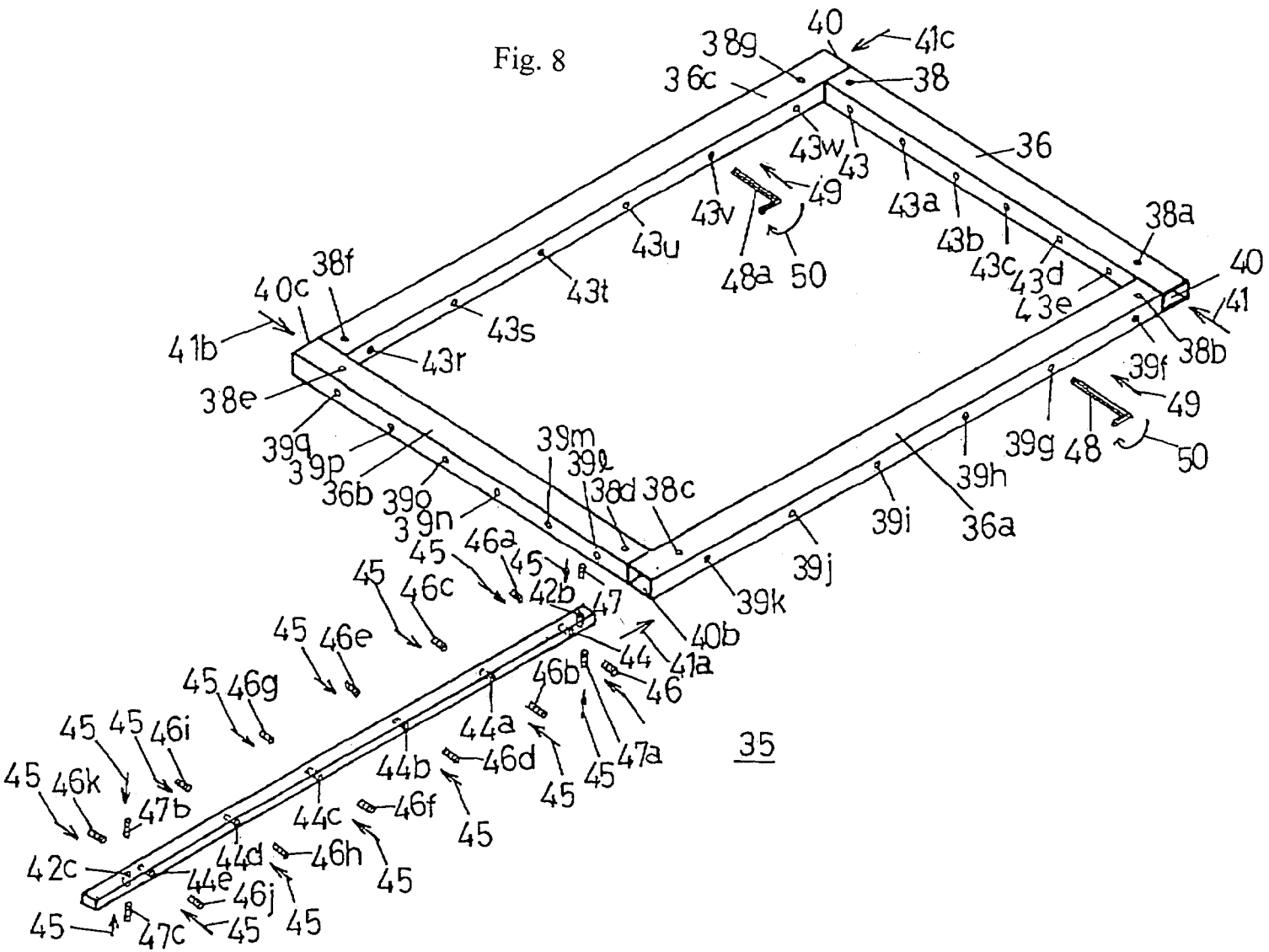
FIG. 8 is a partially cut-off perspective view of frame sides equipped with tension adjusting bars.
Figure 9:
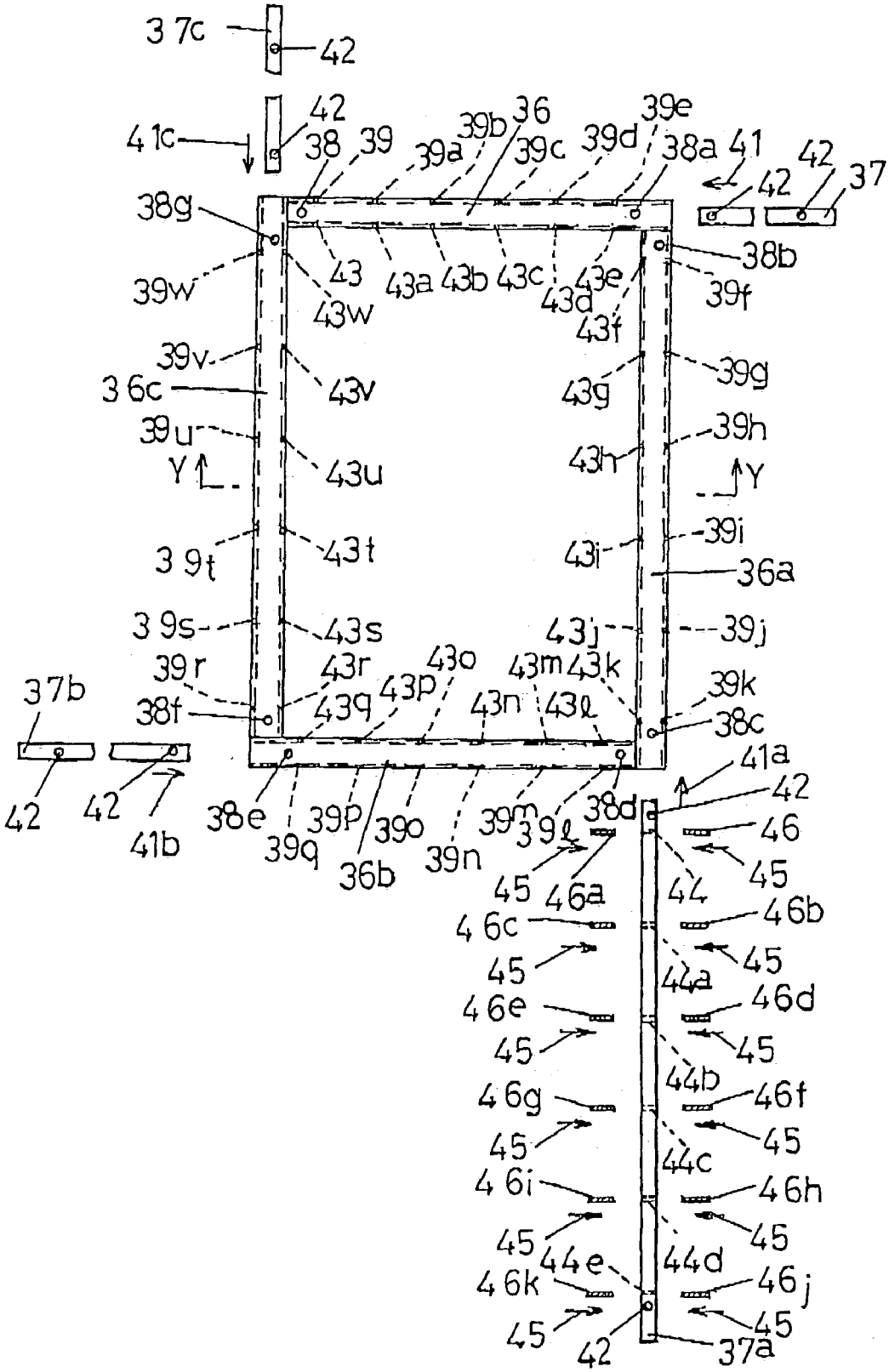
FIG. 9 is a partially cut-off plan view of frame sides equipped with tension adjusting bars.
Figure 10A:
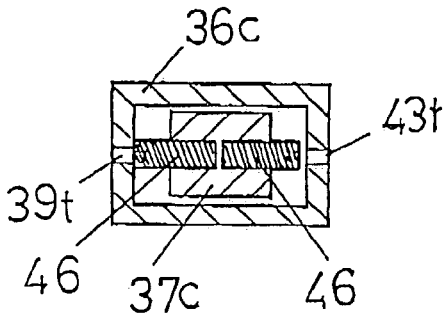
FIG. 10(*a*) is an enlarged cross sectional view at one end of one example of a frame side with a tension adjusting bar, FIG. 10(*b*) is an enlarged cross sectional view at one end of another example of a frame side having a C shape, and FIG. 10(*c*) is an enlarged cross sectional view at one end of a further example of a frame side having an L shape.
Figure 10A:
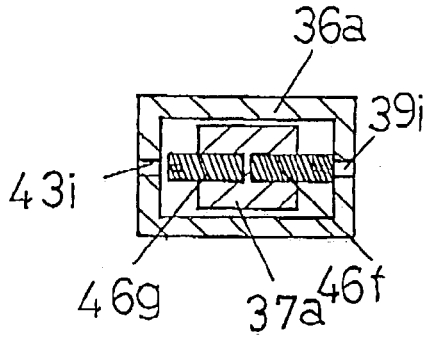
Figure 10B:
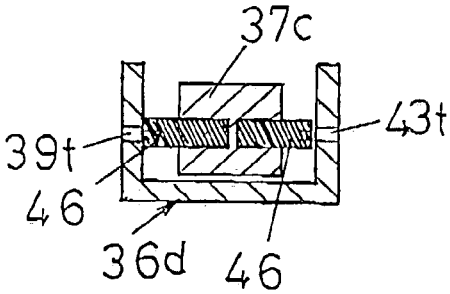
Figure 10B:
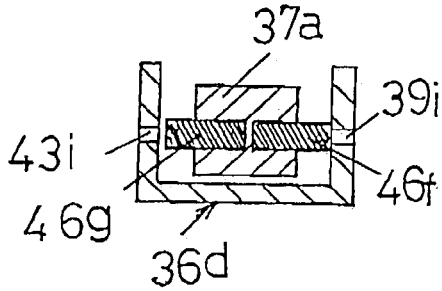
Figure 10C:
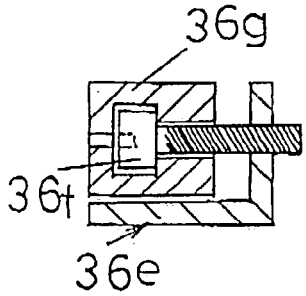
Figure 10C:
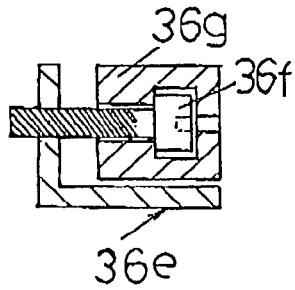

As shown in FIG. 8, the frame sides 36, 36*a*, 36*b*, and 36*c* have outer thread apertures 39, 39*a*, 39*b*, 39*c*, 39*d*, 39*e*, 39*f*, 39*g*, 39*h*, 39*i*, 39*j*, 39*k*, 39*l*, and 39*m* provided in an outer surface thereof respectively, six in each side, inner thread apertures 43, 43*a*, 43*b*, 43*c*, 43*d*, 43*e*, 43*f*, 43*g*, 43*h*, 43*i*, 43*j*, 43*k*, 43*l*, 43*m*, 43*n*, 43*o*, 43*p*, 43*q*, 43*r*, 43*s*, 43*t*, 43*u*, 43*v*, and 43*w* provided in the inner surface thereof respectively (six in each side), and retaining thread apertures 38, 38*a*, 38*b*, 38*c*, 38*d*, 38*e*, 38*f*, and 38*g* provided in an upper surface at both ends thereof for retaining tension adjusting bars.

Four tension adjusting bars have thread apertures provided therein into which tension adjusting screws are threaded. For example, tension adjusting bar 37*a* has thread apertures 44, 44*a*, 44*b*, 44*c*, 44*d*, and 44*e* provided therein. The other three tension adjusting bars are identical. The tension adjusting bars 37, 37*a*, 37*b*, and 37*c* (25×25×900 mm), which are made of a metal (such as iron or steel) or a resin material and are equal in length to a hollow of the frame sides, are inserted into the openings 40, 40*a*, 40*b*, and 40*c* of the hollow frame side of the screen frame 35 from directions denoted by 41, 42, 43, and 44.

Each of the tension adjusting bars has thread apertures 42, 42*a*, 42*b*, 42*c*, 42*d*, 42*e*, 42*f*, and 42*g* provided in both ends thereof for receiving retaining screws.

The tension adjusting bars threaded with the tension adjusting screws into their thread apertures are inserted into openings of corresponding hollow frame sides.

The tension adjusting bar 37 is secured to a corresponding frame side by retaining screws 47*b* and 47*c* threaded vertically from retaining screw apertures into both its ends (50 mm inward from an end) (as equally at another side not shown). The retaining screws retaining the tension adjusting bars at both ends to their respective frame sides serve as fulcrums for deflecting the frame sides 36, 36*a*, 36*b*, and 36*c* with use of tension adjusting screws at intermediate portions.

For deflecting each frame side of the screen printing screen frame to control tension on the screen, the tension adjusting screws are threaded in the tension adjusting bar 37 from corresponding thread apertures provided in the frame side as denoted by 46, 46*a*, 46*b*, 46*c*, 46*d*, 46*e*, 46*f*, 46*g*, 46*h*, 46*i*, 46*j*, 46*k*, 46*l*, and 46*m*.

The screws in this embodiment are headless or set screws. It is however understood that the screws are not limited to these, and may be common machine screws with equal success.

As the tension adjusting screws are accessible through the thread apertures in the frame sides, they can be turned with a wrench 48 or 48*a* in a direction denoted by 50 in FIG. 8 for controlling tension on the screen.

The tension adjusting screws are not limited to six in the embodiment, and may be increased or decreased depending on a length of the frame side.

Action of the hollow screen frame 35 will now be described in more detail.

When a screen attached to the hollow screen frame 35 has been spread and operated for trial printing, the tension adjusting screws 46, 46*a*, 46*b*, 46*c*, 46*d*, 46*e*, 46*f*, 46*g*, 46*h*, 46*i*, 46*j*, 46*k*, 46*l*, and 46*m* threaded into the tension adjusting bar 37 through the thread apertures of the frame side 36*a* are turned to move horizontally to and from inner walls at the hollow of the frame side 36*a*. As a result, the frame side 36*a* can slightly be deflected thus eliminating any unwanted distortion or skew on the screen.

The tension adjusting screws 46 may be turned with the use of a wrench 48 or 48*a* manually or by action of an external servo motor.

Alternatively, adjustment for controlling tension may be conducted by a computer calculating discrepancy in an image between the screen and its print from a location of image positioning markings at every action of printing, and determining a distance for movement of the screen frame.

It was found that printing with the screen of which tension was controlled by this manner created a quality of prints with no distortion or skew.

FIG. 10(*b*) is a cross sectional view of a modification of a frame side which has a C shape 36*d* in cross section. In this modification, distortion or skew on a screen can be eliminated using tension adjusting bars 37 and tension adjusting screws 46. As the tension adjusting bars are secured to a bottom of frame sides (not shown), the same advantageous effect as previously described can be obtained.

FIG. 10(*c*) illustrates an L shape 36*e* in cross section of a frame side of a screen frame. Similarly, distortion or skew on a screen can be eliminated using tension adjusting bars 37 and tension adjusting screws 46. As the tension adjusting bars 37 are secured to a bottom of frame sides (not shown), the same advantageous effect as previously described can be obtained. Also shown are tension adjusting screws of a set screw type 36*f*.

Figure 11:
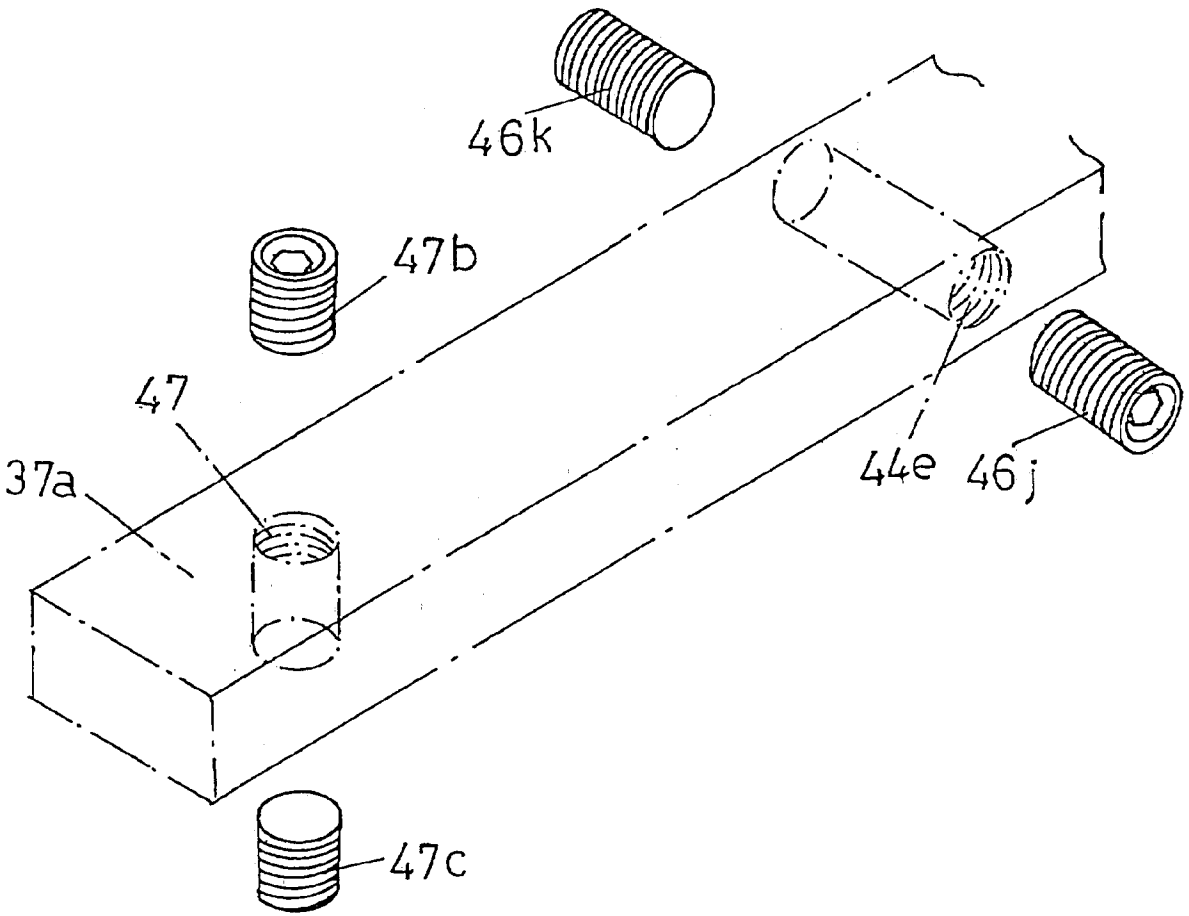
FIG. 11 is a partially cut-off enlarged view showing a relationship between a tension adjusting bar, tension adjusting bar retaining screws, and tension adjusting screws, where two tension adjusting bar retaining screws are provided from above and below while two tension adjusting screws are provided from inside and outside of a frame side.

FIG. 11 illustrates a relationship between tension adjusting bar 37 and tension adjusting screws 46. As shown, a pair of the tension adjusting screws are inserted from both sides of a frame side while a pair of retaining screws are inserted into the tension adjusting bar from above and below.

Figure 12:
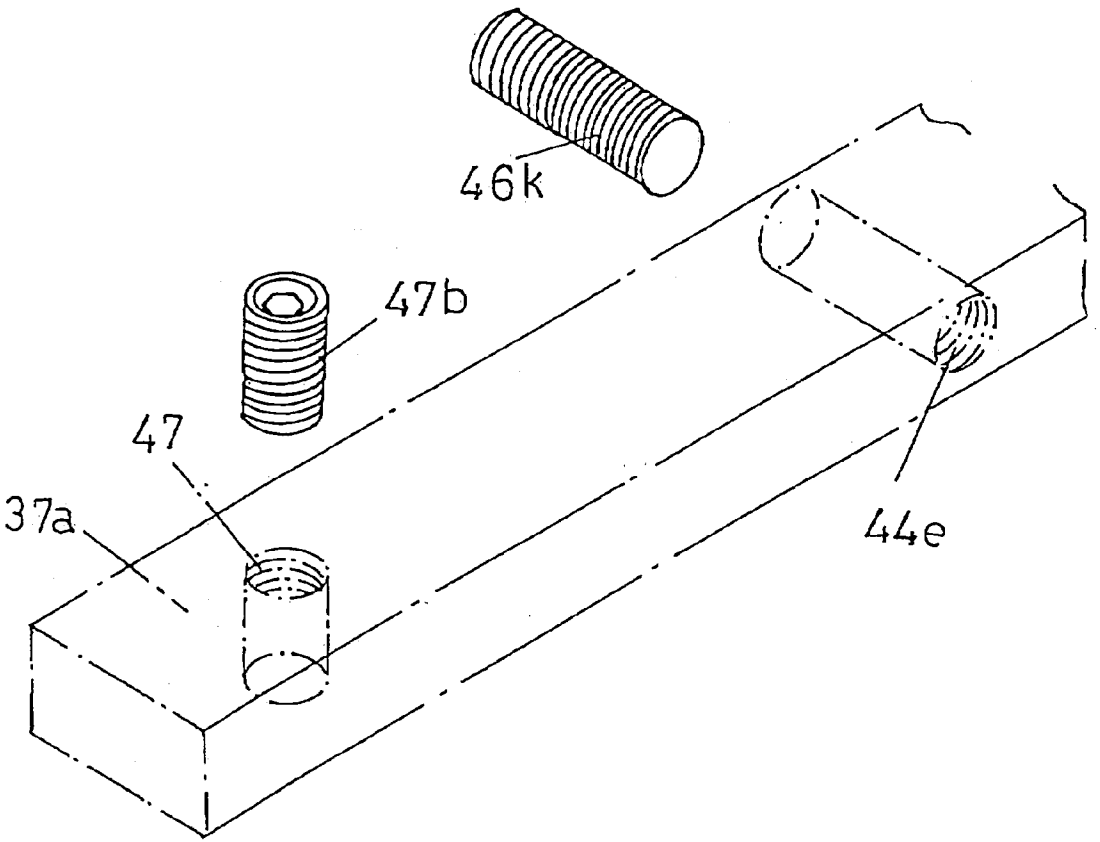
FIG. 12 is a partially cut-off enlarged view showing a relationship between a tension adjusting bar, tension adjusting bar retaining screw, and tension adjusting screw, where the tension adjusting bar retaining screw is provided from above while the tension adjusting screw is provided from inside of a frame side.

FIG. 12 illustrates another relationship between tension adjusting bar 37 and tension adjusting screws 46. As shown, a tension adjusting screw is inserted from an inner side of the frame side while retaining screw 47*b* is inserted into the tension adjusting bar from above.

Figure 13:
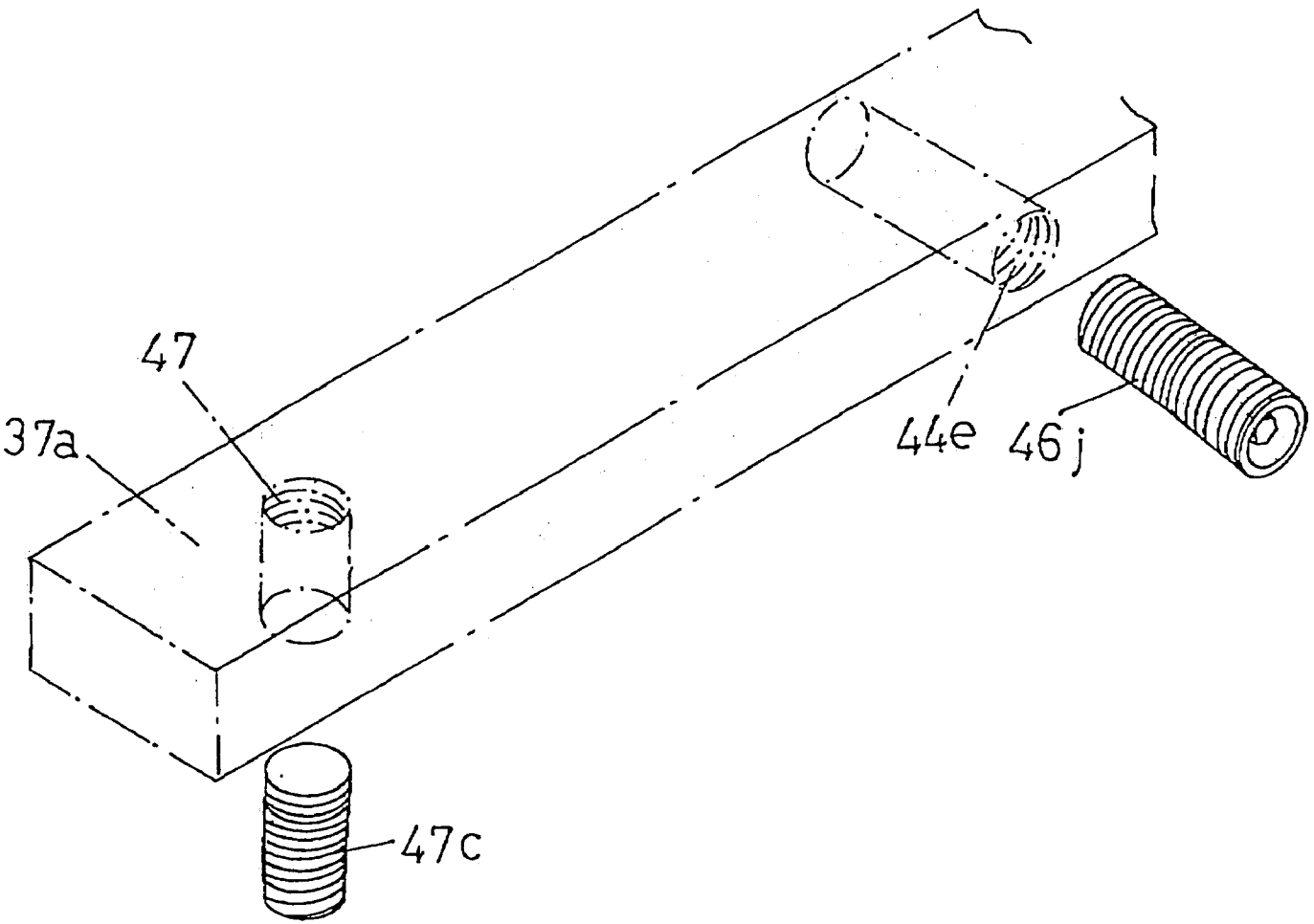
FIG. 13 is a partially cut-off enlarged view showing a relationship between a tension adjusting bar, tension adjusting bar retaining screw, and tension adjusting screw, where the tension adjusting bar retaining screw is provided from below while the tension adjusting screw is provided from outside of a frame side.

FIG. 13 illustrates a further relationship between tension adjusting bar 37*a* and tension adjusting screws 46. As shown, a tension adjusting screw is inserted from an outer side of a frame side while retaining screw 47*c* is inserted into the tension adjusting bar from below.

The invention claimed is:

1. A screen printing screen frame comprising:

four frame sides;

four L-shaped frame corners each having orthogonally arranged first and second corner ends, with said first corner end having an aperture, and said second corner end having a threaded aperture; and four bolts each having a threaded end, wherein a corresponding one of said first and second corner ends is received within a first end of a corresponding one of said four frame sides, and the other of the corresponding one of said first and second corner ends is received within a second end of another corresponding one of said four frame sides, such that said four frame sides and said four L-shaped corners are assembled to define an orthogonal frame shape, and wherein each corresponding one of said four bolts extends through said aperture of said first corner end of a corresponding one of said four L-shaped corners, and said threaded end of said corresponding one of said four bolts is threadably engageable with said threaded aperture of said second corner end of another corresponding one of said four L-shaped corners.

2. The screen printing screen frame according to claim 1, wherein said four bolts also each have a head, with said head being movably receivable within said aperture of said first corner end of a corresponding one of said four L-shaped corners.

3. The screen printing screen frame according to claim 2, wherein said four frame sides and said first and second corner ends each have a square shape in cross section.

4. The screen printing screen frame according to claim 3, wherein lengths of sides of said screen printing screen frame are adjustable upon turning said four bolts.

5. A method of spreading a screen printing screen, comprising:

providing hooking portions in a screen printing screen frame according to claim 3;

engaging hooking tools of a screen printing screen with said hooking portions; and turning said four bolts so as to adjust a length of each side of said screen printing screen frame and thereby provide a tension on the screen printing screen suited for printing.

6. A method of spreading a screen printing screen, comprising:

fixing a screen printing screen to the screen printing screen frame according to claim 3; and turning said four bolts so as to adjust a length of each side of said screen printing screen frame and thereby provide a tension on the screen printing screen suited for printing.

7. The screen printing screen frame according to claim 2, wherein lengths of sides of said screen printing screen frame are adjustable upon turning said four bolts.

8. A method of spreading a screen printing screen, comprising:

providing hooking portions in a screen printing screen frame according to claim 2;

engaging hooking tools of a screen printing screen with said hooking portions; and turning said four bolts so as to adjust a length of each side of said screen printing screen frame and thereby provide a tension on the screen printing screen suited for printing.

9. A method of spreading a screen printing screen, comprising:

fixing a screen printing screen to the screen printing screen frame according to claim 2; and turning said four bolts so as to adjust a length of each side of said screen printing screen frame and thereby provide a tension on the screen printing screen suited for printing.

10. The screen printing screen frame according to claim 1, wherein said four frame sides and said first and second corner ends each have a square cross section.

11. The screen printing screen frame according to claim 10, wherein lengths of sides of said screen printing screen frame are adjustable upon turning said four bolts.

12. A method of spreading a screen printing screen, comprising:

providing hooking portions in a screen printing screen frame according to claim 10;

engaging hooking tools of a screen printing screen with said hooking portions; and turning said four bolts so as to adjust a length of each side of said screen printing screen frame and thereby provide a tension on the screen printing screen suited for printing.

13. A method of spreading a screen printing screen, comprising:

fixing a screen printing screen to the screen printing screen frame according to claim 10; and turning said four bolts so as to adjust a length of each side of said screen printing screen frame and thereby provide a tension on the screen printing screen suited for printing.

14. The screen printing screen frame according to claim 1, wherein lengths of sides of said screen printing screen frame are adjustable upon turning said four bolts.

15. A method of spreading a screen printing screen, comprising:

providing hooking portions in a screen printing screen frame according to claim 1;

engaging hooking tools of a screen printing screen with said hooking portions; and turning said four bolts so as to adjust a length of each side of said screen printing screen frame and thereby provide a tension on the screen printing screen suited for printing.

16. A method of spreading a screen printing screen, comprising:

fixing a screen printing screen to the screen printing screen frame according to claim 1; and turning said four bolts so as to adjust a length of each side of said screen printing screen frame and thereby provide a tension on the screen printing screen suited for printing.

* * * * *